US006626309B1

(12) United States Patent
Jansen et al.

(10) Patent No.: US 6,626,309 B1
(45) Date of Patent: Sep. 30, 2003

(54) TRANSFER SET

(75) Inventors: Hubert Jansen, Jarrie (FR); Jean-Claude Thibault, Saint Egreve (FR)

(73) Assignee: Becton Dickinson France S.A., Le Pont de Claix (FR)

( * ) Notice: Subject to any disclaimer, the term of this patent is extended or adjusted under 35 U.S.C. 154(b) by 249 days.

(21) Appl. No.: 09/684,123

(22) Filed: Oct. 5, 2000

Related U.S. Application Data

(63) Continuation-in-part of application No. 09/420,979, filed on Oct. 20, 1999, which is a continuation-in-part of application No. 09/168,502, filed on Oct. 8, 1998.

(60) Provisional application No. 60/082,372, filed on Apr. 20, 1998.

(51) Int. Cl.[7] ..... B65D 39/00; B65D 41/10; B65D 47/04

(52) U.S. Cl. ..... 215/249; 215/355; 215/DIG. 3; 141/329; 222/83; 604/411; 604/415

(58) Field of Search ..... 215/247, 249, 215/251, 274, 317, 321, 320, 324, 325, 327, DIG. 3, 248, 253, 297, 250, 252, 295, 296; 222/81, 83, 83.5; 141/2, 25–28, 329, 330, 18, 21; 604/403, 406, 411–416; 220/265–268, 278

(56) References Cited

U.S. PATENT DOCUMENTS

| | | | |
|---|---|---|---|
| 37,221 | A | 12/1862 | Dunton |
| 659,519 | A | 10/1900 | De Oliveria |
| 2,342,215 | A | 2/1944 | Perelson |
| 2,388,634 | A | 11/1945 | De Woody |
| 2,524,365 | A | 10/1950 | Smith |
| 2,607,503 | A | 8/1952 | Sonnenberg |
| 2,653,609 | A | 9/1953 | Smith |
| 2,659,370 | A | 11/1953 | Smith |
| 2,667,986 | A | 2/1954 | Perelson |

(List continued on next page.)

FOREIGN PATENT DOCUMENTS

| | | |
|---|---|---|
| EP | 0 236 127 A2 | 3/1987 |
| EP | 0 406 374 B1 | 12/1989 |

(List continued on next page.)

OTHER PUBLICATIONS

German Patent No. DE 36 18 158 A1, May 30, 1986.
Swiss Patent No. 501 172, Dec. 31, 1970.
UK Patent Application No. 2 121 016 A, Jun. 1, 1983.
French Patent No. 950.625, Jul. 28, 1947.
French Patent No. 1.071.487, Feb. 26, 1953.
French Patent No. 1.328.635, Jul. 4, 1962.
French Patent No. 1.487.413,May 20, 1966.
French Patent No. 2.738.550, Sep. 9, 1995—translation attached.
French Patent No. 2.395.198, Jan. 19, 1979.

*Primary Examiner*—Stephen K. Cronin
*Assistant Examiner*—Niki M. Eloshway
(74) *Attorney, Agent, or Firm*—David M. Fortunato

(57) ABSTRACT

A transfer set for transferring fluid from a first container, such as a conventional sealed vial, to. a second container, such as a conventional syringe having a luer connector without a needle canula. The transfer set includes a tubular housing member having a proximate end adapted to be attached to the first container open end, a tubular transfer member located within the tubular housing member, a piercing member telescopically supported in the tubular transfer member, and a cap or closure which in the preferred embodiments releasably retains the distal end of the piercing member prior to removal of the cap. The cap includes a central portion having a tubular connector portion which receives and releasably retains the distal end of the piercing member.

29 Claims, 5 Drawing Sheets

U.S. PATENT DOCUMENTS

| | | | |
|---|---|---|---|
| 2,953,132 | A | 3/1960 | Richter et al. |
| 3,033,202 | A | 5/1962 | Richter et al. |
| 3,164,303 | A | 1/1965 | Trautmann |
| 3,206,080 | A | 9/1965 | Scislowicz |
| 3,278,063 | A | 10/1966 | Kranzhoff |
| 3,356,093 | A | 12/1967 | Monahon |
| 3,357,427 | A | 12/1967 | Wittke et al. |
| 3,610,297 | A | 10/1971 | Raaf et al. |
| 3,674,028 | A | 7/1972 | Ogle |
| 3,779,371 | A | 12/1973 | Rovinksi |
| 3,810,469 | A | 5/1974 | Hurschman |
| 3,826,260 | A | 7/1974 | Killinger |
| 3,838,689 | A | 10/1974 | Cohen |
| 3,872,992 | A | 3/1975 | Larson |
| 3,940,003 | A | 2/1976 | Larson |
| 3,977,555 | A | 8/1976 | Larson |
| 3,995,630 | A | 12/1976 | van de Veerdonk |
| 4,020,839 | A | 5/1977 | Klapp |
| 4,048,999 | A | 9/1977 | Kobel |
| 4,067,440 | A | 1/1978 | Lataix |
| 4,153,057 | A | 5/1979 | Kobel |
| 4,187,893 | A | 2/1980 | Bujan |
| 4,210,255 | A | 7/1980 | Pan |
| 4,296,786 | A | 10/1981 | Brignola |
| 4,336,891 | A | 6/1982 | Smith |
| 4,387,879 | A | 6/1983 | Tauschinski |
| 4,412,623 | A | 11/1983 | Schmidt |
| 4,418,827 | A | 12/1983 | Butterfield |
| 4,425,120 | A | 1/1984 | Sampson et al. |
| 4,460,735 | A | 7/1984 | Froix |
| 4,493,348 | A | 1/1985 | Lemmons |
| 4,505,709 | A | 3/1985 | Froning et al. |
| 4,507,113 | A | 3/1985 | Dunlap |
| 4,564,054 | A | 1/1986 | Gustavsson |
| 4,573,506 | A | 3/1986 | Paoletti |
| 4,573,976 | A | 3/1986 | Sampson et al. |
| 4,576,211 | A | 3/1986 | Valentini et al. |
| 4,588,403 | A | 5/1986 | Weiss et al. |
| 4,619,651 | A | 10/1986 | Kopfer et al. |
| 4,624,393 | A | 11/1986 | Lopez |
| 4,639,250 | A | 1/1987 | Rycroft |
| 4,662,878 | A | 5/1987 | Lindmayer |
| 4,672,996 | A | 6/1987 | Floyd et al. |
| 4,673,404 | A | 6/1987 | Gustavsson |
| 4,675,020 | A | 6/1987 | McPhee |
| 4,792,053 | A | 12/1988 | Towne et al. |
| 4,822,351 | A | 4/1989 | Purcell |
| 4,826,491 | A | 5/1989 | Schramm |
| 4,834,149 | A | 5/1989 | Fournier et al. |
| 4,834,152 | A | 5/1989 | Howson et al. |
| 4,850,994 | A | 7/1989 | Zerbet et al. |
| 4,884,703 | A | 12/1989 | O'Meara |
| 4,909,290 | A | 3/1990 | Coccia |
| 4,913,945 | A | 4/1990 | Maruhashi et al. |
| 4,923,447 | A | 5/1990 | Morgan |
| 4,927,423 | A | 5/1990 | Malmborg |
| 4,932,937 | A | 6/1990 | Gustavsson et al. |
| 4,982,740 | A | 1/1991 | Broden |
| 5,006,118 | A | 4/1991 | Yule |
| 5,024,256 | A | 6/1991 | Vadher |
| 5,035,689 | A | 7/1991 | Schroeder |
| 5,060,812 | A | 10/1991 | Ogle, II |
| 5,088,996 | A | 2/1992 | Kopfer et al. |
| 5,092,840 | A | 3/1992 | Healy |
| 5,116,326 | A | 5/1992 | Schmidt |
| 5,169,385 | A | 12/1992 | Turnball |
| 5,171,214 | A | 12/1992 | Kolber et al. |
| 5,215,538 | A | 6/1993 | Larkin |
| 5,217,433 | A | 6/1993 | Bunin |
| 5,232,029 | A | 8/1993 | Knox et al. |
| 5,232,109 | A | 8/1993 | Tirrell et al. |
| 5,250,037 | A | 10/1993 | Bitdinger |
| 5,275,299 | A | 1/1994 | Konrad et al. |
| 5,279,576 | A | 1/1994 | Loo et al. |
| 5,291,991 | A | 3/1994 | Meyer |
| 5,297,599 | A | 3/1994 | Bucheli |
| 5,342,319 | A | 8/1994 | Watson et al. |
| 5,348,548 | A | 9/1994 | Meyer et al. |
| 5,350,372 | A | 9/1994 | Ikeda et al. |
| 5,352,196 | A | 10/1994 | Haber et al. |
| 5,358,501 | A | 10/1994 | Meyer |
| 5,360,413 | A | 11/1994 | Leason et al. |
| 5,364,386 | A | 11/1994 | Fukuoka et al. |
| 5,385,546 | A | 1/1995 | Kriesel et al. |
| 5,397,303 | A | 3/1995 | Sancoff et al. |
| 5,409,125 | A | 4/1995 | Kimber et al. |
| 5,411,499 | A | 5/1995 | Dudar et al. |
| 5,415,374 | A | 5/1995 | Carroll et al. |
| 5,419,256 | A | 5/1995 | Pollich |
| 5,421,814 | A | 6/1995 | Geary |
| 5,423,791 | A | 6/1995 | Bartlett |
| 5,425,465 | A | 6/1995 | Healy |
| 5,429,256 | A | 7/1995 | Kestenbaum |
| 5,433,330 | A | 7/1995 | Yatsko et al. |
| 5,433,703 | A | 7/1995 | Utterberg et al. |
| 5,435,282 | A | 7/1995 | Haber et al. |
| 5,437,648 | A | 8/1995 | Graves et al. |
| 5,441,487 | A | 8/1995 | Vedder |
| 5,454,409 | A | 10/1995 | McAffer et al. |
| 5,454,805 | A | 10/1995 | Brony |
| 5,466,219 | A | 11/1995 | Lynn et al. |
| 5,470,319 | A | 11/1995 | Mayer |
| 5,470,327 | A | 11/1995 | Helgren et al. |
| 5,474,541 | A | 12/1995 | Ritsky et al. |
| 5,474,544 | A | 12/1995 | Lynn |
| 5,487,737 | A | 1/1996 | Meyer |
| 5,494,170 | A | 2/1996 | Burns |
| 5,501,676 | A | 3/1996 | Niedospial et al. |
| 5,514,116 | A | 5/1996 | Vaillancourt et al. |
| 5,514,117 | A | 5/1996 | Lynn |
| 5,520,641 | A | 5/1996 | Behnke et al. |
| 5,520,642 | A | 5/1996 | Bigagli et al. |
| 5,520,661 | A | 5/1996 | Lal et al. |
| 5,520,665 | A | 5/1996 | Fleetwood |
| 5,520,666 | A | 5/1996 | Choudhury et al. |
| 5,533,983 | A | 7/1996 | Haining |
| 5,533,994 | A | 7/1996 | Meyer |
| 5,549,651 | A | 8/1996 | Lynn |
| 5,566,729 | A | 10/1996 | Grabenkort et al. |
| 5,573,516 | A | 11/1996 | Tyner |
| 5,573,520 | A | 11/1996 | Schwartz et al. |
| 5,573,525 | A | 11/1996 | Watson et al. |
| 5,573,526 | A | 11/1996 | Hess |
| 5,576,392 | A | 11/1996 | Yamamoto et al. |
| 5,598,939 | A | 2/1997 | Watson et al. |
| 5,613,291 | A | 3/1997 | Solomon et al. |
| 5,616,129 | A | 4/1997 | Mayer |
| 5,616,130 | A | 4/1997 | Mayer |
| 5,620,434 | A | 4/1997 | Brony |
| 5,641,010 | A | 6/1997 | Maier |
| 5,662,230 | A | 9/1997 | Finneran |
| 5,685,845 | A | 11/1997 | Grimard |
| 5,697,915 | A | 12/1997 | Lynn |
| 5,702,019 | A | 12/1997 | Grimard |
| 5,709,666 | A | 1/1998 | Reynolds |
| 5,718,348 | A | 2/1998 | Manera |
| 5,776,124 | A | 7/1998 | Wald |
| 5,776,125 | A | 7/1998 | Dudar et al. |
| 5,785,701 | A | 7/1998 | Sams et al. |
| 5,803,284 | A | 9/1998 | Grimard |
| 5,819,964 | A | 10/1998 | Grimard |

| | | | | | |
|---|---|---|---|---|---|
| 5,833,089 | A | | 11/1998 | Manni et al. | |
| 5,855,575 | A | | 1/1999 | Solomon et al. | |
| 5,857,579 | A | | 1/1999 | Finneran | |
| 5,863,655 | A | | 1/1999 | Mock | |
| 5,873,872 | A | | 2/1999 | Thibault et al. | |
| 5,879,345 | A | | 3/1999 | Aneas | |
| 5,891,129 | A | | 4/1999 | Daubert et al. | |
| 5,925,029 | A | | 7/1999 | Jansen et al. | |
| 5,931,828 | A | | 8/1999 | Durkee | |
| 5,954,104 | A | | 9/1999 | Daubert et al. | |
| 5,957,898 | A | | 9/1999 | Jepson et al. | |
| 6,003,566 | A | | 12/1999 | Thibault et al. | |
| 6,050,435 | A | | 4/2000 | Bush et al. | |
| 6,056,135 | A | | 5/2000 | Widman | |
| 6,070,623 | A | | 6/2000 | Aneas | |
| 6,071,270 | A | | 6/2000 | Fowles et al. | |
| 6,159,192 | A | | 12/2000 | Fowles et al. | |
| 6,189,580 | B1 | * | 2/2001 | Thibault et al. | 141/25 |
| 6,209,738 | B1 | * | 4/2001 | Jansen et al. | 141/329 |
| 6,378,714 | B1 | * | 4/2002 | Jansen et al. | 141/329 |
| 6,382,442 | B1 | * | 5/2002 | Thibault et al. | 215/247 |

FOREIGN PATENT DOCUMENTS

| | | | |
|---|---|---|---|
| EP | 0 065 469 | A2 | 5/1992 |
| EP | 0 769 456 | A2 | 10/1996 |
| EP | 0 747 293 | A1 | 12/1996 |
| FR | 1.328.635 | | 7/1962 |
| WO | WO 84/04673 | | 12/1984 |
| WO | WO 88/01881 | | 3/1988 |
| WO | WO 92/11056 | | 7/1992 |
| WO | WO 94/03373 | | 3/1994 |
| WO | WO 95/00117 | | 1/1995 |
| WO | PCT WO 95/03841 | | 2/1995 |
| WO | WO 95/14176 | | 5/1995 |
| WO | WO 95/31242 | | 11/1995 |
| WO | WO 95/33505 | | 12/1995 |
| WO | WO 95/35125 | | 12/1995 |
| WO | WO 96/13301 | | 5/1996 |
| WO | WO 97/00702 | | 1/1997 |
| WO | WO 97/10156 | | 3/1997 |
| WO | WO 97/39720 | | 10/1997 |
| WO | PCT WO 98/13006 | | 4/1998 |
| WO | PCT WO 98/32411 | | 7/1998 |
| WO | WO 98/37853 | | 9/1998 |
| WO | PCT WO 98/37854 | | 9/1998 |

* cited by examiner

TRANSFER SET

RELATED APPLICATIONS

This Application is a continuation-in-part of U.S. application Ser. No. 09/420,979, filed Oct. 20, 1999, which is a continuation-in-part of U.S. application Ser. No. 09/168,502, filed Oct. 8, 1998, which claims priority under 35 U.S.C. Section 119(e) to U.S. Provisional Application Ser. No. 60/082,372, filed Apr. 20, 1998.

FIELD OF THE INVENTION

This invention relates to an improved transfer set for transferring fluid from a first container, such as a conventional vial having a pierceable closure or stopper, and a second container, such as a syringe.

BACKGROUND OF THE INVENTION

It is conventional to store drugs, vaccines, medicaments and solutions in a sealed vial or other container for later use. Drugs, vaccines, medicaments and solutions may be stored in a dry or powdered form to increase the shelf life and reduce inventory space. Such dry or powdered materials may be stored in a conventional sealed vial having a pierceable closure, such as an elastomeric stopper, and reconstituted in liquid form for later use, such as administration to a patient, by adding a diluent or solvent. Alternatively, such drugs, vaccines, medicaments and solutions may be stored in a liquid or even a gaseous form. A conventional vial for storing such materials in liquid, dry or gaseous form includes an open end, a radial rim portion surrounding the open end and a reduced diameter neck portion adjacent the rim portion. The vial is conventionally sealed with an elastomeric stopper or other pierceable closure which generally includes a tubular portion inserted in the open end in the neck of the vial and a planar rim portion which overlies the vial rim. The stopper is conventionally secured to the vial with a thin malleable metal cap, such as aluminum. Because aluminum is malleable, the collar accommodates the buildup of tolerances of the dimensions on the stopper and vial rim.

Recently, various vial transfer sets have been proposed for transferring fluid between a vial and a conventional syringe, wherein the transfer set is mounted on the vial for later use. The transfer set may include a piercing member, such as a needle canula generally telescopically mounted in a tubular fluid transfer member mounted on the open end of the vial. The transfer set may be enclosed by a cup-shaped closure or housing having a radial flange secured to the vial by a malleable metal or plastic collar.

Transfer sets have been utilized, for example, to transfer fluid from a vial to a syringe, such as a reconstituted dry or powdered drug, vaccine or medicament by adding a diluent or solvent in the syringe. The reconstituted drug may then be withdrawn from the vial by the syringe. The inner surface of the transfer set may be part of the fluid path and the aluminum collar or ring may bring aluminum particles into the sterile room where the drug, vaccine or medicament is added to the vial or into the drug path contaminating the drug, vaccine or medicament. There have been attempts to reduce this problem by applying a protective coating to the aluminum cap or collar. Finally, the prior art also includes snap-on cup-shaped plastic caps or collars having radially inwardly projecting end portion which is snapped over the rim of the vial. Snap-on collars, however, do not assure adequate sealing of the vial or fully accommodate the tolerances of standard vials and stoppers, as required.

The prior art also discloses plastic transfer sets for vials. However, such plastic transfer sets are relatively expensive having several interfitting parts and are difficult to use. The need therefore remains for a transfer set for vials or other containers which may be utilized with conventional vials, such as vials or cartridges used by the medical industry, which assures sealing of the container and which achieves a good level of cleanliness, without particles or dust which may contaminate the drugs, vaccines or medicaments, the transfer set or the clean room, and which does not expose the health care worker to sharp, metal edges. The need also remains for a transfer set which may be easily secured to a vial or other container and which is relatively simple in construction and easy to use.

SUMMARY OF THE INVENTION

The improved transfer set of this invention may be utilized, for example, to transfer fluid between a conventional vial having a pierceable closure or stopper and a conventional syringe having a luer threaded connector without a needle canula. However, the transfer set of this invention is universal in that it can be utilized to transfer fluid from any container having a pierceable closure and a second container. The components of the transfer set may be formed of polymers, preferably a polymer which may be sterilized for medical applications. In the most preferred embodiments of the transfer set of this invention, where the collar portion of the tubular housing member is radially deformed or crimped into the reduced diameter neck portion of the vial as described herein, the tubular housing member is preferably formed of a polymer which may be permanently deformed radially to secure the transfer set to the vial or container, yet sufficiently rigid to retain its shape following deformation and resistant to creep to maintain a good seal between the container and the transfer set, thereby avoiding contamination.

The improved transfer set of this invention includes a tubular housing member having a proximate end adapted to be attached to the first container open end and an open distal end. For ease of description only, the term "proximate" is used herein to designate the portions of the transfer set closest to the first container or vial to which the transfer set may be attached and the term "distal" is used herein to refer to the portions of the components furthest from the first container. A cap is releasably attached over the open distal end of the tubular housing member, sealing the open distal end. The transfer set further includes a piercing member which is telescopically supported in the tubular housing member having a proximate piercing end adapted to pierce the closure in the open end of the container and a distal end. In the most preferred embodiments of the improved transfer set disclosed herein, the transfer set further includes a tubular transfer member located within the tubular housing member having a proximate end adapted to sealingly engage the pierceable closure in the open end of the first container and an open distal end. In the preferred embodiments disclosed in the above-referenced parent applications, the piercing member is releasably secured by interfering surfaces of the tubular transfer member and the piercing member. Further, the tubular transfer member is integral with the tubular housing member, wherein the tubular transfer member is connected to the tubular housing member by an integral radial web.

In the most preferred embodiment of the transfer set first disclosed in this application, the distal end of the piercing member is releasably attached to the cap simplifying the assembly of the transfer set and assuring release of the piercing member following removal of the cap. The preferred embodiment of the cap includes a central portion overlying the distal open end of the tubular housing member having a central connector portion which receives and releasably retains the distal end of the piercing member. In the most preferred embodiment, the connector portion and the distal end of the piercing member includes a camming surface having a major diameter greater than the internal diameter of the tubular connector portion of the cap, providing an interference fit. In the disclosed embodiment, the camming surface on the free distal end of the piercing member is generally spherical or semi-spherical terminating in a relatively sharp edge which bites into the internal surface of the central tubular portion of the cap, thereby releasably retaining the piercing member to the cap. The preferred embodiment of the cap further includes an outer tubular portion which is received around the distal open end of the tubular housing member having a frangible connector portion adjacent the central portion, such as an annular groove. Thus, the central portion of the cap may be removed and the piercing member is retained by the cap until the central portion is removed. The disclosed embodiment of the cap further includes an inner tubular portion concentric with the outer tubular portion adjacent to but spaced from the outer tubular portion which is received within the open distal end of the tubular housing member assuring a good seal of the open distal end of the tubular housing member. Further, in the disclosed embodiment, the outer surface of the tubular housing member adjacent the open distal end includes an annular radial rib which is received in an annular groove in the interior surface of the outer tubular portion of the cap preferably located adjacent to the frangible connector portion assuring retention of the cap on the tubular housing member prior to removal of the central portion.

The most preferred embodiment of the generally tubular transfer member is retained to the tubular housing member by an integral radially inwardly projecting rib extending from the internal surface of the tubular transfer member. The tubular transfer member preferably includes a camming surface, which in the disclosed embodiment is frusto-conical, having an annular end surface received on the radially inwardly projecting rib of the tubular housing member. The frusto-conical surface has a major diameter which is greater than the internal diameter of the radially inwardly projecting rib, such that the tubular transfer member may be inserted into the housing member from the proximate open end, wherein the camming surface resiliently biases the radially inwardly projecting rib of the tubular housing member out of the way for receipt of the annular end surface of the camming surface on the radially inwardly projecting rib of the tubular housing member. In the most preferred embodiment of the tubular transfer member, the external surface adjacent the open distal end includes a luer thread for receipt of a conventional female luer thread of a syringe or other container, providing fluid communication between the first container and the second container through the tubular transfer member. The piercing member in the disclosed embodiment includes a V-shaped external channel which provides fluid communication between the first container following piercing of the closure by the piercing member and the second container. It will be understood, however, that the piercing member may include a longitudinal passage or an interrupted external passage of any shape depending upon the application.

In one preferred embodiment of the improved transfer set of this invention, rotation of the tubular transfer member is prevented during threaded attachment of a syringe or other container by interlocking longitudinally extending ribs on the external surface of the tubular transfer member and the internal surface of the tubular housing member. Although only one rib is required on each of the tubular transfer member and the tubular housing member, the disclosed embodiment includes three ribs. In the alternative embodiment, the proximate end of the tubular transfer member includes a radial portion which is compressed against the resilient stopper during assembly, preventing rotation of the tubular transfer member relative to the tubular housing member. As will be understood, however, other means may be utilized to prevent rotation of the tubular transfer member during threaded attachment to the second container or the anti-rotation means may be eliminated where the second container is not threaded to the tubular transfer member.

Where the improved transfer set of this invention is to be sealingly attached to a vial or other container having a rim portion surrounding the open end and a reduced diameter neck portion, the proximate end of the tubular housing member preferably includes an integral radial portion adapted to overlie the rim portion of the closure or stopper and a tubular collar portion integral with the radial portion. In the most preferred embodiment, where the tubular housing member is formed of a polymer as described above, the free end of the tubular collar portion is deformed radially inwardly or crimped into the neck portion of the vial or other container permanently attaching the tubular transfer member to the first container. Having described the components of the preferred embodiments of the tubular transfer member of this invention, the assembly may now be described.

In the embodiments of the tubular transfer member first described in the above-referenced parent applications, the piercing member is inserted into the tubular transfer member and is retained therein by interlocking ribs and grooves on the piercing member and the tubular transfer member. The cover or cap is attached to the open distal end of the tubular housing member either by adhesive bonding in one embodiment or by inserting the inner tubular portion of the cap into the open distal end of the tubular housing member which receives the outer tubular portion around the open distal end. In the preferred embodiment first disclosed in this application, the tubular transfer member is separate from the tubular housing member as described. The tubular transfer member is then inserted into the open proximate end of the tubular housing member and then driving the frusto-conical camming surface against the radially inwardly projecting rib of the tubular housing member, resiliently biasing the radially inwardly projecting rib out of the way and receiving the annular end surface on the radially inwardly projecting rib. The cap is then attached over the open distal end of the tubular housing member and the piercing member is then inserted through the open proximate end of the tubular transfer member and connected to the cap as described above. Finally, the transfer set is sealingly attached to the first container, such as a vial, preferably by receiving the collar portion of the tubular housing member over the vial and radially deforming the free end into the neck portion of the vial or container.

The transfer set of this invention may then be used to transfer fluid between the first container to which it is attached and a second container through the tubular transfer member. In a typical application wherein the first container, such as a vial, contains a drug, vaccine, medicament or solution in dry or liquid form, and the material is ready for use, the cover or cap is removed by breaking the frangible connection between the central portion of the cap and the outer tubular portion, exposing the luer threads on the outer surface of the tubular transfer member adjacent the open distal end. The second container, such as a syringe without a needle canula having a female luer thread, is then threadibly attached to the male luer thread adjacent the distal end of the tubular transfer member. The tubular end portion of the syringe is thereby received within the tubular transfer member, driving the piercing member to pierce the pierceable closure, such as a conventional elastomeric stopper, providing fluid communication between the first container and the second container. In the preferred embodiment of the transfer set, wherein the piercing member is releasably attached to the cap as described above, the removal of the central portion of the cap releases the piercing member and the tubular portion of the syringe is then received against the piercing member distal end during threaded attachment as described above.

Other advantages and meritorious features of the improved transfer set of this invention will be more fully understood from the following description of the preferred embodiments, the appended claims and the drawings, a brief description of which follows.

DESCRIPTION OF THE PREFERRED EMBODIMENTS OF THIS INVENTION

Figure 1:
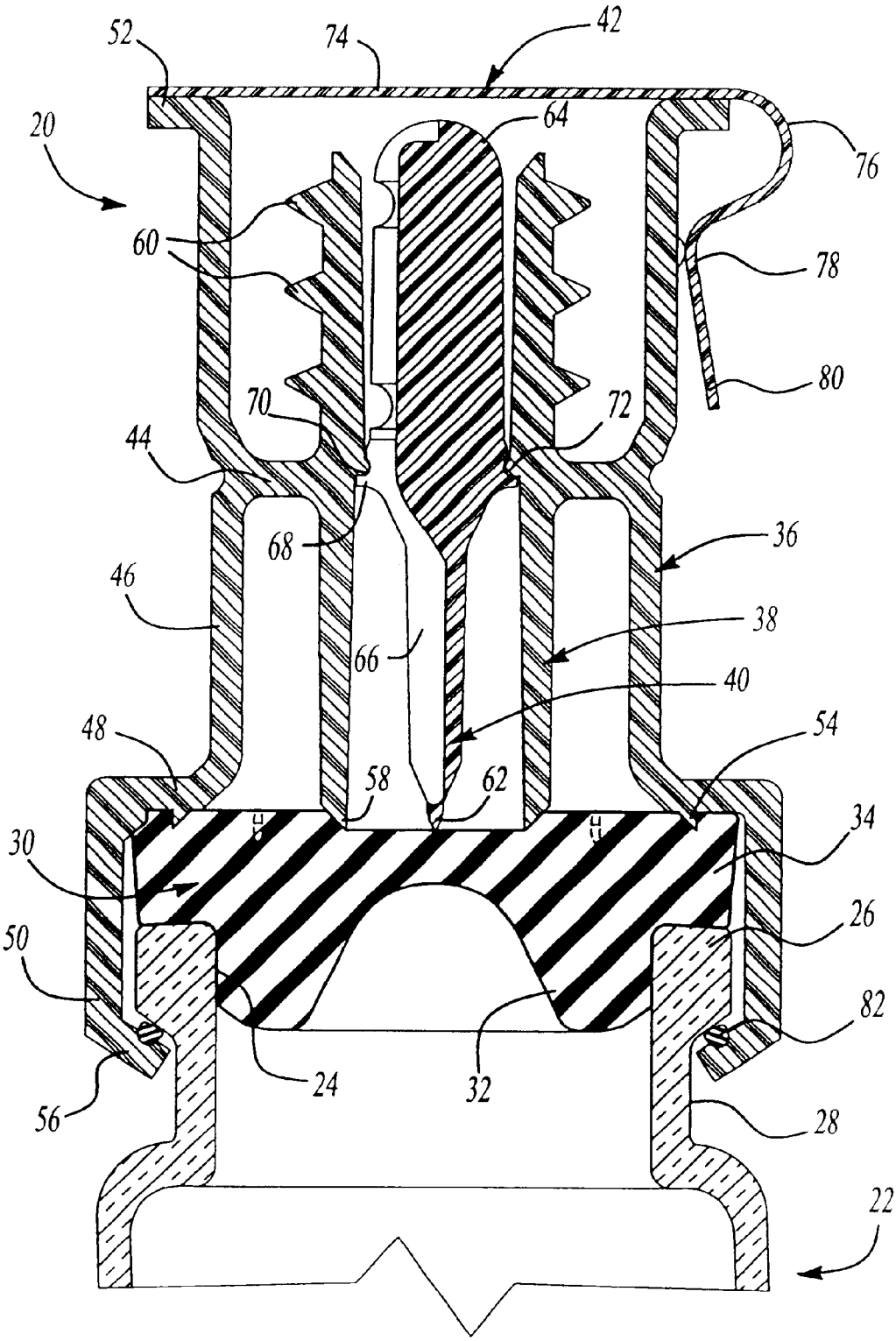
FIG. 1 is a side cross-sectional view of one embodiment of a transfer set attached to a conventional vial ready for use.

FIG. 1 illustrates one embodiment of the transfer set of this invention 20 attached to a conventional vial 22. As set forth above, the transfer set of this invention is universal in that it can be utilized to transfer fluids from any container to another. However, one advantage of the transfer set of this invention is that it can be utilized to transfer fluids between a conventional vial, such as shown at 22, and a conventional syringe (not shown) without a needle canula. The vial 22 illustrated in FIGS. 1 and 2 includes an opening 24, a rim portion 26 surrounding the open end and a reduced diameter neck portion 28. The vial is conventionally formed of glass or plastic. The opening 24 is conventionally sealed with an elastomeric stopper 30 which includes a generally tubular portion 32 having a diameter slightly greater than the internal diameter of the opening 24 to provide a tight seal and a rim portion 34 overlying the rim portion 26 of the vial.

The transfer set 20 in the disclosed embodiment includes a tubular housing member 36, a tubular transfer member 38, a piercing member 40 telescopically received in the tubular transfer member 38 and a closure or cap 42 which seals the distal end of the tubular housing member 36 as shown. In the disclosed embodiment, the tubular housing member 36 is integral with the tubular transfer member 38 by a radial web portion 44.

Figure 2:
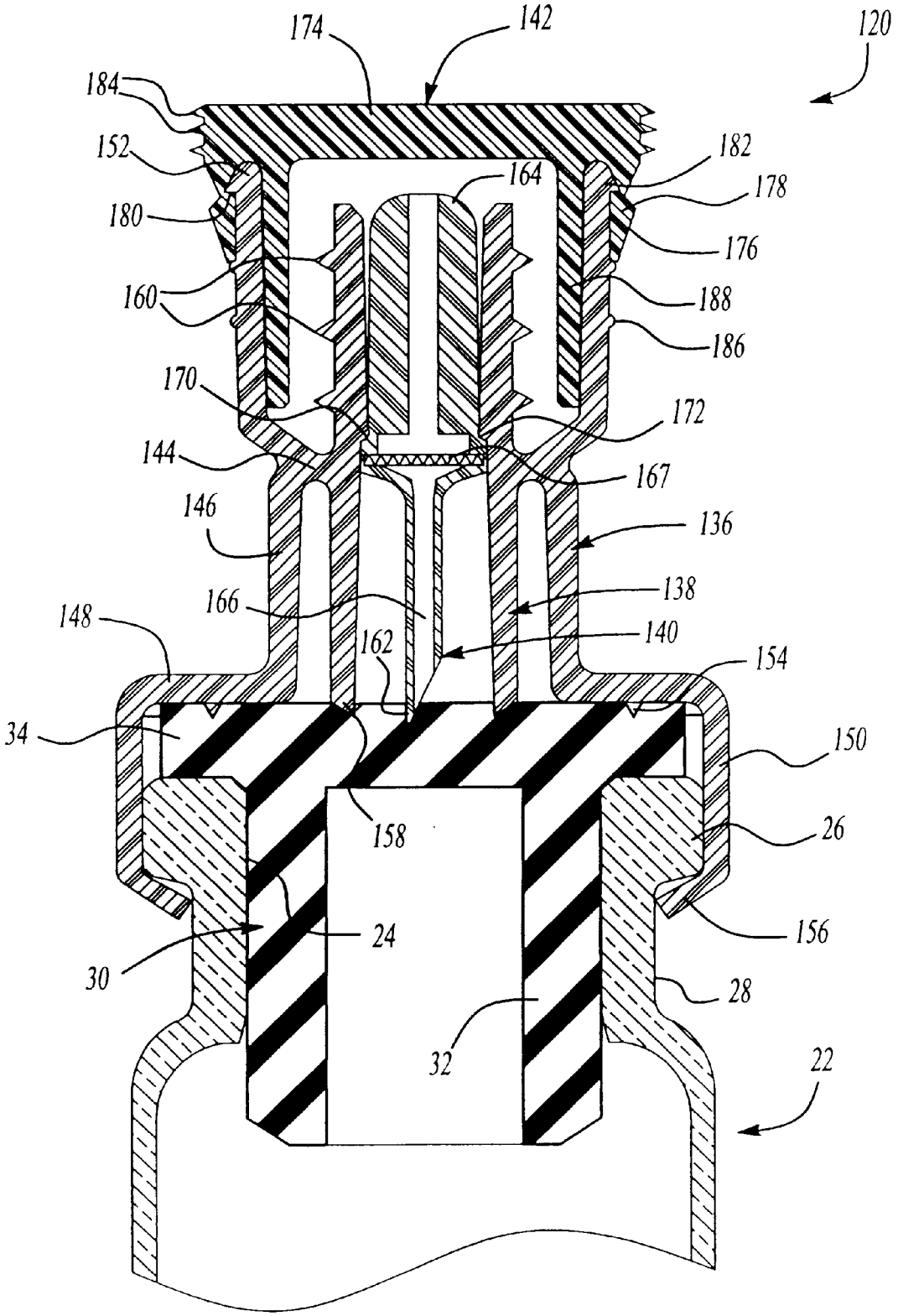
FIG. 2 is a side cross-sectional view of a second embodiment of the transfer set attached to a conventional vial.

The tubular housing member 36 in the disclosed embodiment includes a tubular housing portion 46 which surrounds the tubular transfer member 38 and the piercing member 40, a radial portion 48 which overlies the rim portions of the elastomeric stopper 34 and the vial 26, and a tubular collar portion 50. The distal end of the tubular transfer. portion 36 includes a radial flange portion 52 which receives the closure or cap 42 as disclosed below. The radial portion 48 in the disclosed embodiment includes an annular barb 54 which is compressed against the rim portion 34 of the stopper during assembly which provides an improved seal. The free end 56 of the tubular collar portion 50 is deformed radially inwardly or crimped during assembly of the transfer set 20 on the vial 22 to permanently attach the transfer set to the vial as described below. The tubular transfer member 38 in the disclosed embodiment includes a relatively sharp proximate end portion 58 which bites into the elastomeric stopper 30 during assembly providing a sealed communication between the vial 22 and the interior surface of the tubular transfer member 38 as described below. The tubular transfer member further includes male luer threads 60 for threaded attachment of the tubular transfer member to a second container, such as a conventional syringe without a needle canula as described below. The piercing member 40 includes a proximate piercing end 62, a distal ends 64 and a longitudinal channel 66. Although the most preferred embodiment of the piercing member includes a longitudinal channel 66, the channel need not be continuous and may extend axially through the piercing member as shown in FIG. 2. The piercing member further includes a radial flange 66 which limits upward movement of the piercing member as shown and a radial annular groove 70 which receives the annular rib 72 on the interior surface of the tubular transfer member 38. The piercing member 40 is thus releasably secured within the tubular transfer member 40 during assembly.

In the disclosed embodiment, the cover or cap 42 includes a central portion 74 which is received over the radial flange 52 of the tubular housing member and secured thereto by any suitable means, including glue. The cap further includes a tab portion 78 having a mid-portion 78, which may be adhesively bonded to the exterior surface of the tubular housing member 46 as shown, and a free end 80 which may be gripped by the health care worker to remove the cap. Having described the components of the transfer set 20 shown in FIG. 1, the assembly of the components will now be briefly described. First, the transfer set 20 is assembled by inserting the piercing member 40 into the open proximate end 58 of the tubular transfer member 38 until the radial flange 68 is received against the annular rib 72 and the rib is received in the annular groove 70. The piercing member 40 is thus releasably retained in the tubular transfer member 38. The cap 42 is attached to the radial flange 52 at the distal end of the tubular housing member 32 by any suitable means, including adhesive bonding. Finally, the assembled transfer set 20 is assembled on the vial 22 by compressing the radial portion 48 of the tubular housing member against the radial rim portion 34 of the stopper 30 and the free end 56 of the collar portion is then deformed radially or crimped into the neck portion 28 of the vial, as shown. In the disclosed embodiment, an annular sealing ring 82 is received between the free end 56 of the collar portion 50 of the tubular housing member to prevent entry of foreign material and provide a seal.

FIG. 2 illustrates an alternative embodiment of a transfer set 120 attached to a conventional vial 22 described above. The transfer set 120 shown in FIG. 2 includes a tubular housing member 136, a tubular transfer member 138 located within the tubular housing member, a piercing member 140 and a closure or cap 142. The tubular housing member 136 is generally as described above in regard to the housing member 36 shown in FIG. 1 and therefore no further detailed description is required. For ease of description and to avoid duplication of description, like components or elements are numbered in the same sequence as in FIG. 1. Thus, for example, the male luer threads 60 on the tubular transfer member 38 are numbered 160 in FIG. 2, etc. The primary differences between the transfer set 120 shown in FIG. 2 and the transfer set 20 shown in FIG. 1 relate to the piercing member 140 and the cap 142 as now described. The piercing member 140 illustrated in FIG. 2 includes a proximate piercing end 162 and a distal end 164; however, in this embodiment, the piercing member 140 includes a longitudinal axial passage or canula 166 and a filter 167 for filtering fluid transferred through the passage 166. The filter 167 preferably is disc-shaped and may be any conventional filter, including porous and semi-permeable polymeric filters. As shown, the proximate piercing end 162 of the piercing member 140 is relatively sharp to pierce the planar rim portion 34 of the closure or stopper 30. As described above, the piercing member 140 is releasably retained in the tubular transfer member 138 by an annular groove 170 on the piercing member which received a radial rib 172 on the internal surface of the tubular transfer member.

The cap 142 in the embodiment disclosed in FIG. 2 includes a central portion 174 which overlies the open distal end 152 of the tubular housing portion 146 of the generally tubular housing member 136 and an integral outer tubular portion 176 having a frangible connector portion 178 in the form of a groove and the tubular housing member 144 includes an annular rib 180 which is received in an annular groove 182 in the cap adjacent the frangible connector portion 178. The outer surface of the central portion 174 of the cap further includes a plurality of relatively sharp gripping ribs 184 and the tubular housing portion 144 includes a plurality of spaced ribs 186. The frangible connector portion 178 may be broken by either tilting or twisting the central portion 178 to remove the central portion of the rib, fracturing the frangible connector portion 178. The ribs 184 provide a good gripping surface for removal of the central portion 174 when the transfer set 120 is ready for use. In addition, severance of the frangible connector portion 182 in response to initial separation of the central portion from the outer tubular portion 178 of the cap provides unmistakable evidence of tampering with the transfer set of this invention. The cap 142 in this embodiment further includes an inner integral tubular portion 188 which is received within the open distal end 152 of the tubular housing portion 146 which provides a seal against contamination of the transfer set prior to use and assists assembly of the cap on the outer tubular housing portion 146. That is, the inner tubular portion 188 is first received in the open distal end 152 of the tubular housing portion 146 and then the central portion 174 is pressed into the tubular housing portion 146 until the radial rib 180 snaps into the annular groove 182.

Figure 3:
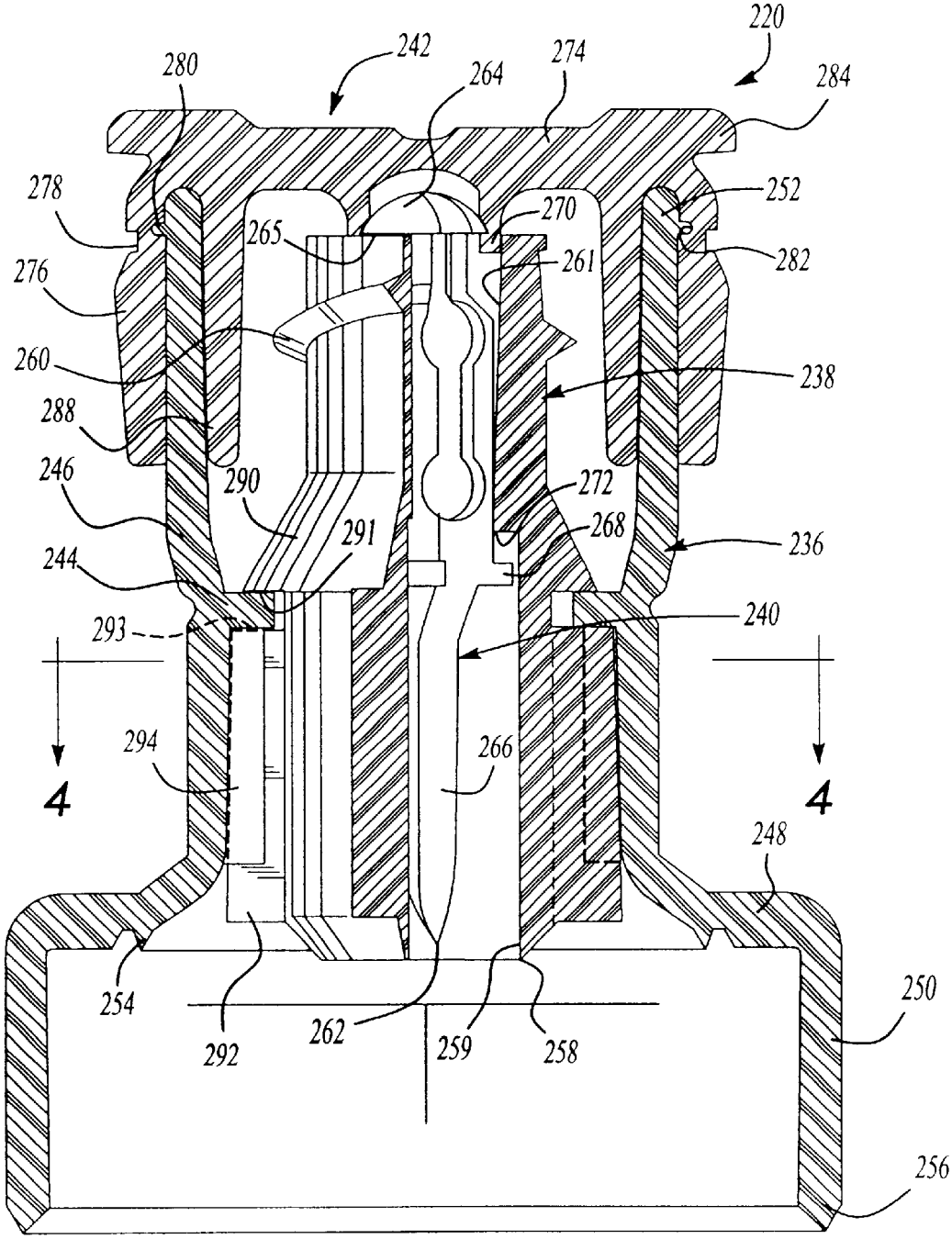
FIG. 3 is a side cross-sectional view of a third preferred embodiment of the transfer set of this invention prior to attachment to a container, such as a vial.
Figure 4:
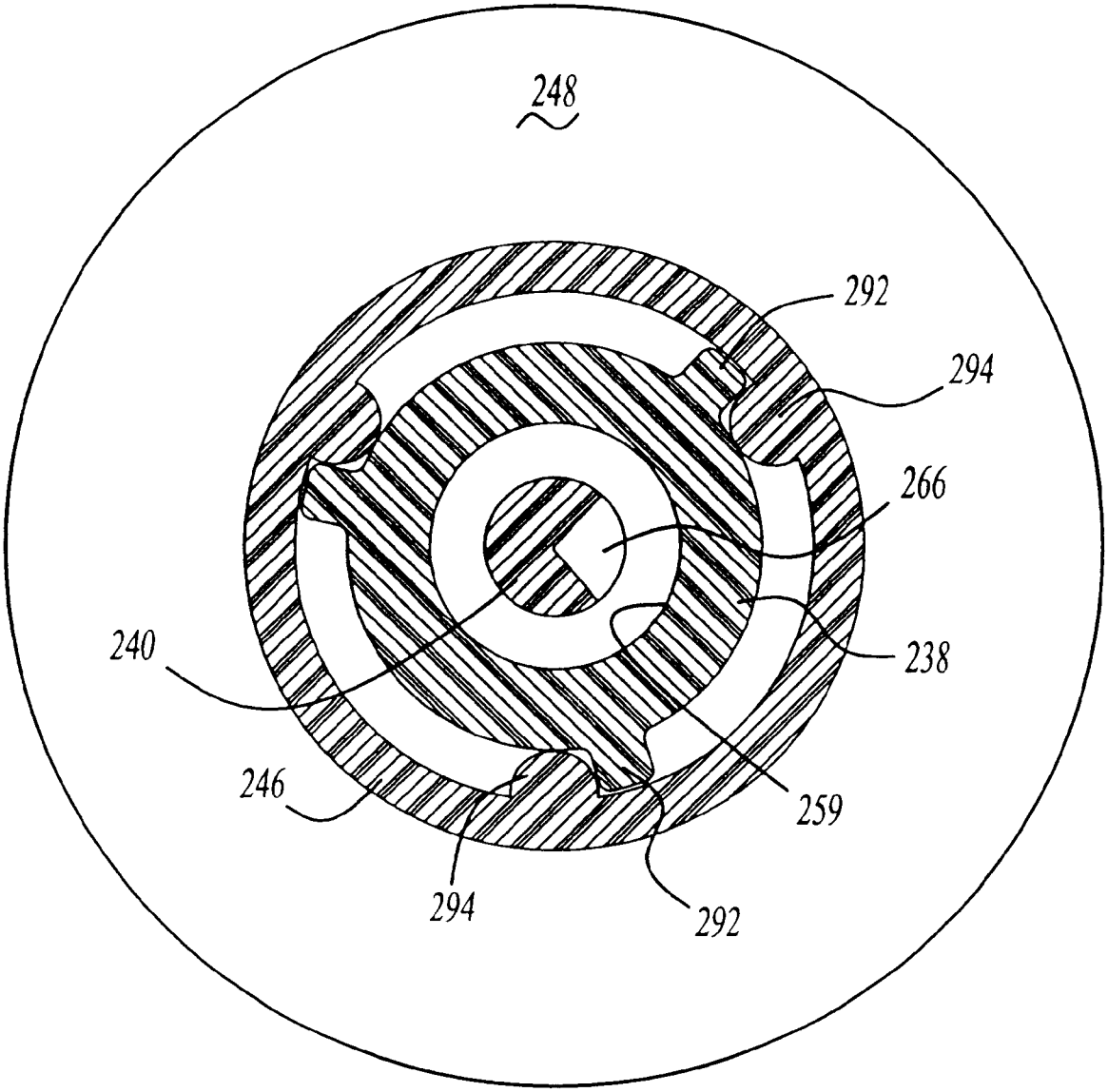
FIG. 4 is an end cross-sectional view of FIG. 3 in the direction of view arrows 4—4.

A preferred embodiment of the transfer set 220 is shown in FIGS. 3 and 4, which includes a tubular housing member 236, a tubular transfer member 238, a piercing member 240 and a cap 242. As described above, the tubular housing member 236 includes a tubular housing portion 246 which surrounds the components of the transfer set having an open distal end 252, a proximate radial portion 248 and a tubular collar portion 250. As described above, the radial portion 248 is adapted to overlie the rim portion 34 of the stopper and the rim portion 26 of the vial (not shown). The radial portion includes an annular barb 254 adapted to bite into the rim portion 34 of the stopper during assembly of the transfer set 220 on the vial, and the free end 256 of the collar portion 250 is adapted to secure the transfer set on the vial as described above.

In the embodiment of the transfer set 220 shown in FIG. 3, the tubular housing portion 246 of the tubular housing member 236 is not formed integral with the tubular transfer member 238. Instead, the tubular housing portion 246 includes a radial rib 244 which supports the tubular transfer member 238 as described below.

The tubular transfer member 238 includes a proximate end portion 258 which is relatively sharp to bite into the closure in the open end of the container to which it is attached (not shown) to provide sealed communication between the container and the interior surface 259 of the tubular transfer member as described above. As shown at the right in FIG. 1, the internal surface 261 of the tubular transfer member 238 adjacent the distal end is tapered or conical having a larger internal diameter adjacent the distal end than the internal diameter adjacent the radial surface 272, such that the radial flange 268 on the piercing member 240 may be received through the distal end as described below. The tubular transfer member further includes an open distal end 252 and a male luer thread 260 for threaded attachment to a second container (not shown) as discussed below. The cap 242 includes a generally planar central portion 274, an integral outer tubular portion 276 which surrounds the tubular housing portion 246 as shown having a frangible connector portion 178 in the form of an annular groove. The tubular housing portion 246 further includes a radial annular rib 280 which is received in an annular groove 282 in the tubular housing portion 246 adjacent the frangible connector portion 278 retaining the cap 242 on the tubular housing portion 246 and further weakening the frangible connector portion 278 for removal of the cap as described below. In this embodiment, the generally planar center portion 274 includes a radial rim portion 284 which assists in removing the central portion 274 when the transfer set is ready for use. The cap further includes an integral inner tubular portion 288 which is received in the free open end 252 of the tubular housing portion 246 to improve the seal between the cap 242 and the distal open end 252 of the tubular housing portion 246. The piercing member 240 is generally similar to the piercing member 40 disclosed in FIG. 1 and includes a proximate piercing end 262, a distal end 264 described more fully hereinbelow and a longitudinal channel 266 which provides fluid communication between the container to which the transfer set 220 is attached and the internal surfaces 259 and 261 of the tubular transfer member as described below. The piercing member 240 further includes a radial flange 268 which abuts against the annular internal surface 272 limiting upward movement of the piercing member 240 in the tubular transfer member 238 as shown in FIG. 3. In this embodiment, however, the piercing member 240 is not releasably retained by an interlocking rib and groove on the internal surface of the tubular transfer member 38 and the exterior surface of the piercing member 240 as described above in regard to FIG. 1. Instead, the piercing member is releasably retained in the cap 242 as described below.

As best shown in FIG. 3, the distal end 264 of the piercing member 240 is generally hemispherical or semi-hemispherical providing a camming surface for receipt of the distal end 264 of the piercing member in the integral tubular connector portion 270 located generally in the center of the central portion 274 of the cap. Further, the semi-hemispherical camming portion 264 terminates in a relatively sharp edge 265 which bites into the internal surface of the tubular connector portion 270 as shown in FIG. 3. The piercing member 240 is thus releasably retained by the cap 274 during assembly and prior to removal of the central portion 274 as described below. The exterior surface of the tubular transfer member 238 further includes a camming surface 290 for assembly of the tubular transfer member in the tubular housing member 236 as described below having an annular end surface 291 which is received on and supported by the radially inwardly projecting rib 244 on the tubular housing portion 246, as shown. In this embodiment, the exterior surface of the tubular transfer member 238 further includes a plurality of integral radial longitudinally extending ribs 292 and the inwardly projecting radial rib 244 is received between the annular end surface 291 of the camming surface 290 and the distal end 293 of the longitudinal ribs 292, securely retaining the tubular transfer member 238 in the tubular housing portion 246 of the tubular housing member 236 as shown. Further, the internal surface of the tubular housing portion 246 includes a plurality of radial longitudinally extending ribs 294 which prevent rotation of the tubular transfer member 238 in the tubular housing member 236 as now described in regard to FIG. 4. As shown in FIG. 4, in the disclosed embodiment of the transfer set 220, the tubular transfer member 238 includes three equally spaced radially extending longitudinal ribs 292 and the internal surface of the tubular housing portion 246 includes the same number of radially extending longitudinal ribs 292. These ribs 292 and 294 prevent rotation of the tubular transfer member 238 in the tubular housing portion 246 during threading attachment of the tubular transfer member to a second container having luer threads as described below.

The embodiment of the transfer set 220 shown in FIG. 3 may be attached to a conventional vial as described above, such as the conventional vial 22 shown in FIGS. 1 and 2 or any other suitable container. As described above, the vial may contain drugs, vaccines, medicaments or solutions in dry, liquid or even gaseous form. In a typical medical application of the transfer set of this invention, the vial may contain drugs, vaccines or medicaments in dry or powdered form which may be reconstituted for administration to a patient by adding a diluent or solvent. The diluent or solvent may be contained in a second container, such as a conventional syringe having a luer connector and a central tubular portion without a needle canula. The first step in reconstituting a dry or powdered drug, vaccine or medicament is to remove the cap 242. In the embodiments shown in FIG. 3, the central portion of the cap 274 is removed by gripping the radial flange portion 284 with the thumb, for example, and tilting the central portion, breaking the frangible portion 278. This motion also releases the piercing member 240 from the cap 242. The female threaded luer connector portion of a syringe for example (not shown) is then threaded onto the male luer thread 260, which drives the central tubular portion of the syringe into the internal surface 261 of the tubular transfer member against the distal end 264 of the piercing member, driving the piercing end 262 through the pierceable closure, such as the elastomeric stopper 30 shown in FIGS. 1 and 2. Fluid communication is thus provided between the first container and the syringe through the channel 266 of the piercing member into the internal surfaces 259 and 261 of the tubular transfer member. The diluent or solvent may then be received from the second container into the first container. The reconstituted drug, vaccine or medicament may then be withdrawn from the first container by the syringe for administration to a patient. The assembly of the components of the transfer set 220 will be described below following the description of the transfer set 320 shown in FIG. 5 as follows.

Figure 5:
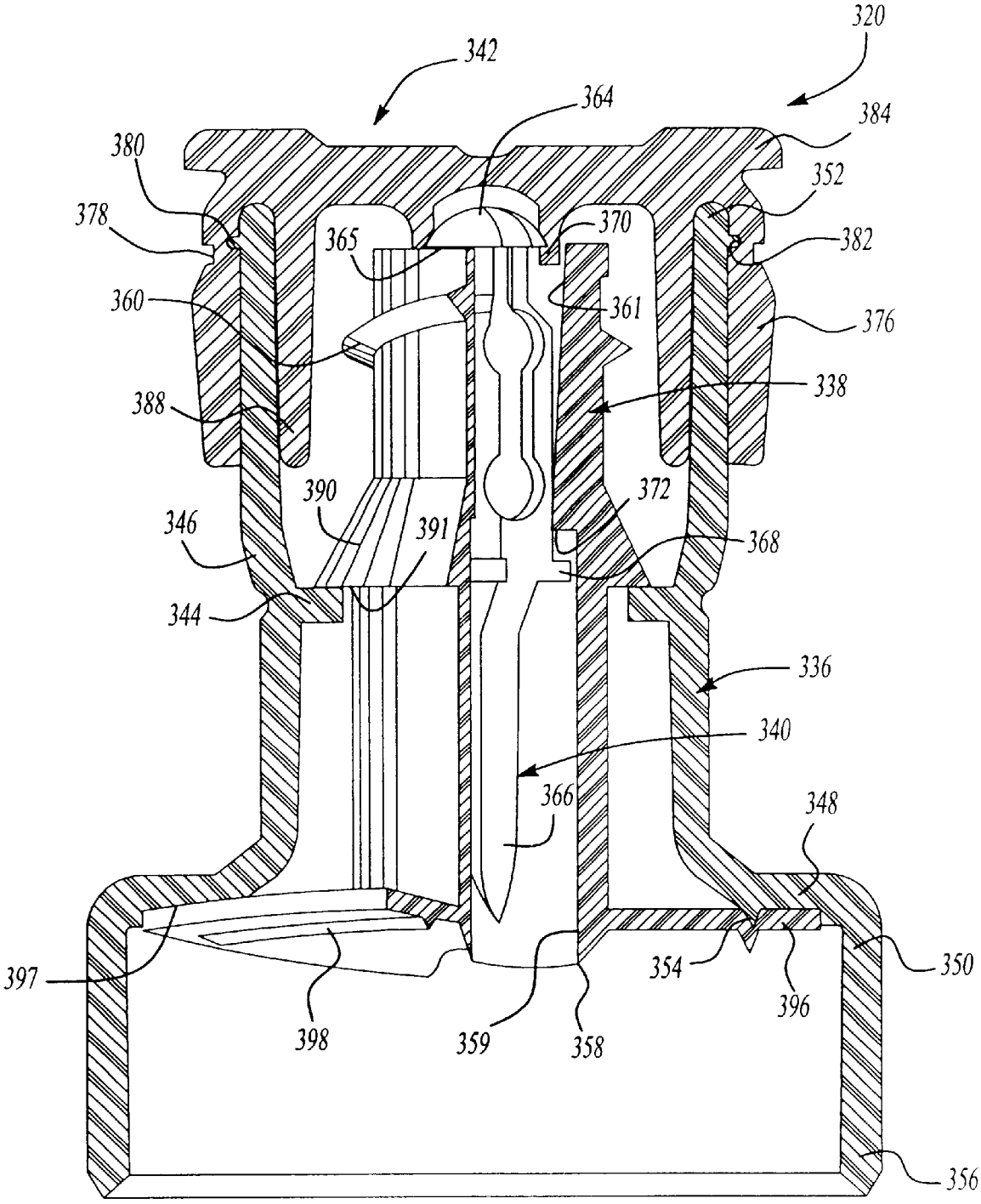
FIG. 5 is a side cross-sectional view of another preferred embodiment of the transfer set of this invention prior to attachment to a vial or other container.

The embodiment of the transfer set 320 shown in FIG. 5 includes the same components as the transfer set 220 shown in FIGS. 3 and 4 except for the means preventing relative rotation between the tubular transfer member 338 and the tubular housing portion 346 of the tubular housing member 236. As set forth above, like components or elements are numbered in the same sequence in FIG. 5 to avoid duplication of description. In the embodiment of the transfer set 320 shown in FIG. 5, the proximate end of the tubular transfer member 338 includes a radial flange 396 which is received in an annular groove 397 in the radial portion 348 of the tubular housing member 336. The annular barb 354 then bites into the radial flange 396, which is compressed against the rim portion 34 of the closure 30 shown in FIGS. 1 and 2. In this embodiment, the radial flange further includes radial barbs 398 which bite into the rim portion of the stopper providing an additional seal. The remaining components of the transfer set 320 may be identical to the transfer set 220 shown in FIG. 3 and described above and therefore no further description of these components is required.

The assembly of the components of the transfer sets 220 and 320 will now be briefly described. First, the tubular transfer member 238 or 338 is assembled in the tubular housing member 236 or 336 from the open proximate end adjacent the collar portion. This is accomplished by driving the camming surface 290 or 390 against the inwardly projecting radial rib 244 or 344, which biases the rib out of the way, such that the annular end surface 291 or 391 is received on the rib 244 or 344 as shown. In the embodiment of the transfer set 220 shown in FIG. 3, the radial rib 240 is thus trapped between the annular end surface 291 of the camming surface 290 and the distal end 293 of the radially extending longitudinal rib 292. The piercing member 240 or 340 is then received through the distal end of the tubular transfer member until the radial flange 268 or 368 is received through the smaller diameter portion 261 or 361 into the larger diameter portion 259 or 359, as shown. As described above, the internal surface 261 in FIG. 3 and 361 in FIG. 5 is slightly conical having a greater diameter adjacent the distal end of the tubular transfer member 238 or 338, such that the radial flange 268 in FIG. 3 and 368 in FIG. 5 on the piercing member may be received through the internal surface from the distal end of the tubular transfer member. Finally, the cap 242 is received on the distal end 252 or 352 of the tubular transfer member, whereby the camming surface 264 is received in the central tubular connector portion 270 or 370, wherein the relatively sharp edge 265 or 365 bites into the internal surface of the tubular portion, releasably retaining the piercing member to the cap. As will be understood, the camming surface 264 or 364 at the distal end of the piercing member may take various shapes and is therefore not limited to a semi-spherical surface as shown and described above. Further, the camming surface 290 or 390 on the tubular transfer member may also be of any shape providing a camming surface and is not limited to a frusto-conical surface shown. Finally, as will be understood, the various components of the transfer set are preferably formed of plastic or various polymers such that the radially inwardly projecting rib 244 or 344 may be resiliently biased out of the way during assembly by the camming surface 290 or 390 as described and the camming surface 264 or 364 will resiliently bias or expand the tubular connector portion 270 or 370 as described.

As set forth above, the preferred embodiments of the transfer set of this invention may be permanently secured to a conventional vial 32 or other container preferably including a radial rim portion 26 surrounding an open end 24 having a reduced diameter neck portion 28 by deforming the free end (56, 156, 256 or 356) into the reduced diameter neck portion of the vial against the radial rim portion 26 as by crimping or other suitable means. Where this method is used to secure the transfer set to the vial or other container, it is important that the polymer selected for the tubular housing member be sufficiently malleable to permit radial deformation or crimping, yet sufficiently rigid to retain its shape following deformation and resistant to creep to maintain a good seal between the collar portion of the transfer set and the vial. Suitable polymers for the plastic tubular housing member include EASTAR™ MB polymers, which are melt blend and alloy polymers and EASTAR™ thermal plastic polymers, which are neat polymers sold by Eastman Chemical Company of Kingsport, Tenn. and Eastman Chemical AG of Zug, Switzerland under the trade names "DA003," "DN003" and "DN004." These materials are polymer melt blends, alloys and copolymers of polycarbonate or polyamide and polyester. As used herein, the terms melt blends and alloys refer to polymeric compositions having two or more polymers of different physical properties or characteristics, such as the above polymers available from Eastman Chemical Company which include a polycarbonate or polyamide and a polyester. The polymer selected may also include fillers and other constituents which would be more accurately described as a composite, although the base polymers may still be a polymeric blend or alloy. As used herein, the term composite is used in its broadest sense to include alloys or melt blends, composites and copolymers. As will be understood, the manufacturer or supplier of the raw material will normally blend the polymers based upon the specifications of the customer. The polymers may be co-injected to form a polymeric blend, alloy or composite or formed by any other suitable process. It is anticipated, however, that other polymers having the described physical characteristics may also be utilized for the plastic tubular housing member of the embodiments of the transfer sets of this invention. Further, the other components of the disclosed embodiments of the transfer set of this invention may be formed of other suitable plastics including the above described polymers. However, in medical applications, polymers should be selected which may be sterilized.

As will be understood by those skilled in this art, various modifications may be made to the embodiments of the transfer sets of this invention within the purview of the appended claims. For example, various closures may be utilized in addition to the caps and closures described. Further, the luer thread may be replaced with a connector suitable for connection of the tubular transfer member to other containers or eliminated where the transfer set is utilized for transferring fluid between other containers. Having described the preferred embodiments of the improved transfer set of this invention, the transfer set is now claimed, as follows.

What is claimed is:

1. A transfer set for transferring fluid from a first container having an open end sealed with a pierceable closure and a second container, said transfer set comprising:

a tubular housing member having a proximate end adapted to be attached to said first container open end and an open distal end;

a cap releasably attached to said open distal end of said tubular housing member sealing said open distal end, wherein said cap includes a central tubular portion extending toward and receiving said distal end of said piercing member, releasably retaining said piercing member; and a piercing member telescopically supported in said tubular housing member by said cap having a proximate piercing end adapted to pierce said closure of said first container and a distal end releasably attached to said cap, said cap releasably retaining said piercing member during assembly of said transfer set on said first container and prior to removal of said cap, wherein said piercing member distal end has an enlarged free end including a camming surface having a diameter greater than an internal diameter of said central tubular portion of said cap which is received in said central tubular portion terminating in a relatively sharp edge which bites into an internal surface of said central tubular portion of said cap, releasably retaining said piercing member to said cap.

2. The transfer set as defined in claim 1, wherein said camming surface of said piercing member is generally semi-spherical.

3. The transfer set as defined in claim 1, wherein said cap includes a central portion overlying said open distal end of said tubular housing member and an outer tubular portion received on said open distal end of said tubular housing member having a frangible connector portion permitting removal of said central portion by breaking said frangible connector portion.

4. The transfer set as defined in claim 3, wherein said outer tubular portion of said cap surrounds an outer surface of said tubular housing member adjacent said open distal end and said cap includes an inner tubular portion concentric with but spaced from said outer tubular portion received within said distal open end of said tubular housing member.

5. The transfer set as defined in claim 3, wherein said frangible connector portion of said cap is an annular groove in said outer tubular portion of said cap and said distal open end of said tubular housing member and said outer tubular portion of said cap having an interlocking annular groove and rib located adjacent said frangible connector portion.

6. The transfer set as defined in claim 1, wherein said transfer set includes a generally tubular transfer member supported within said tubular housing member telescopically receiving said piercing member having a proximate end adapted to sealingly engage said closure and an open distal end.

7. The transfer set as defined in claim 6, wherein said tubular transfer member is supported within said tubular housing member by a radially inwardly projecting integral rib on said tubular housing member.

8. The transfer set as defined in claim 7, wherein said tubular transfer member includes a frusto-conical camming surface having a major diameter greater than an internal diameter of said radially inwardly projecting rib of said tubular housing member and an annular end surface received on said rib.

9. The transfer set as defined in claim 7, wherein said tubular transfer member includes a longitudinal rib having an end surface adjacent to but spaced from said annular end surface of said inwardly projecting integral rib and said radially projecting integral rib received between said annular end surface of said frusto-conical camming surface and said end surface of said longitudinal rib supporting and retaining said tubular transfer member within said tubular housing member.

10. The transfer set as defined in claim 9, wherein said tubular housing member includes an internal radial longitudinally extending rib adjacent said longitudinal rib on said tubular transfer member having an internal diameter greater than an external diameter of said longitudinal rib of said tubular transfer member preventing rotation of said tubular transfer member relative to said tubular housing member.

11. The transfer set as defined in claim 6, wherein said tubular transfer member includes a luer threaded portion adjacent said open proximate end adapted to receive a luer threaded portion of said second container.

12. The transfer set as defined in claim 6, wherein said tubular housing member includes a proximate integral radial portion adapted to overlie said first container open end and an integral tubular collar portion adapted to be secured to said first container and said tubular housing member proximate end having a radial portion located adjacent said radial portion of said tubular housing member.

13. A transfer set for transferring fluid from a first container having an open end sealed with a pierceable closure and a second container, said transfer set comprising:

a tubular housing member having a proximate end adapted to be attached to said first container open end and an open distal end;

a generally tubular transfer member located within said tubular housing member having a proximate end adapted to sealingly engage said closure in said open end of said first container;

a cap having a central portion overlying and sealing said open distal end of said tubular housing member, wherein said cap central portion includes an integral connector releasably retaining said piercing member distal end, wherein said integral connector is a central tubular portion extending toward and receiving said distal end of said piercing member releasably retaining said piercing member; and a piercing member telescopically received in said tubular transfer member having a proximate piercing end adapted to pierce said closure and a distal end releasably attached to said cap central portion, whereby said cap releasably retains said piercing member during assembly of said transfer set on said first container prior to removal of said cap, wherein said piercing member distal end includes an enlarged free end having a camming surface having a diameter greater than an internal diameter of said central tubular portion of said cap which is received in said central tubular portion terminating in a relatively sharp edge which bites into an internal surface of said central tubular portion of said cap, releasably retaining said distal end of said piercing member in said central tubular portion.

14. The transfer set as defined in claim 13, wherein said camming surface of said piercing member distal end is generally spherical.

15. The transfer set as defined in claim 13, wherein said cap includes an outer integral tubular portion received on said open distal end of said tubular housing member having a frangible connector portion permitting removal of said central portion by breaking said frangible connector portion.

16. The transfer set as defined in claim 15, wherein said outer tubular portion of said cap surrounds an outer surface of said tubular housing portion adjacent said open distal end and said cap includes an inner integral tubular portion concentric with but spaced from said outer tubular portion received within said distal open end of said tubular housing member.

17. The transfer set as defined in claim 15, wherein said frangible connector portion of said cap is an annular groove in said outer tubular portion of said cap and said distal open end of said tubular housing member and said outer tubular portion of said cap include an interlocking annular groove and rib located adjacent said frangible connector portion.

18. The transfer set as defined in claim 13, wherein said tubular transfer member is supported within said tubular housing member by a radially inwardly projecting integral rib on said tubular housing member.

19. The transfer set as defined in claim 18, wherein an outer surface of said tubular transfer member includes a camming surface having a major diameter greater than an internal diameter of said radially inwardly projecting rib of said tubular housing member having an annular end surface received on said rib.

20. The transfer set as defined in claim 19, wherein said camming surface is frusto-conical having a major diameter facing said proximate end of said tubular transfer member and terminating in said annular end surface received on said inwardly projecting integral rib on said tubular housing member.

21. The transfer set as defined in claim 19, wherein an internal surface of said tubular transfer member includes an integral longitudinal rib having an end surface adjacent to but spaced from said annular end surface of said camming surface and said radially projecting rib on said internal surface of said tubular housing member is received between said annular end surface of said camming surface and said end surface of said longitudinal rib supporting and retaining said tubular transfer member within said tubular housing member.

22. The transfer set as defined in claim 21, wherein an internal surface of said tubular housing member includes an integral longitudinally extending rib adjacent said longitudinal rib of said tubular transfer member having an internal diameter greater than an external diameter of said longitudinal rib of said tubular transfer member preventing rotation of said tubular transfer member relative to said tubular housing member.

23. The transfer set as defined in claim 13, wherein said tubular transfer member includes a luer threaded portion adjacent said open proximate end adapted to receive a luer threaded portion of said second container.

24. A transfer set for transferring fluid from a first container having an open end, a rim portion surrounding said open end, a reduced diameter neck portion adjacent said rim portion, a pierceable closure received in said open end sealing said first container and a second container, said transfer set comprising:

a generally tubular housing member including a tubular collar portion adapted to surround said rim portion of said first container having a free end adapted to be secured to said neck portion of said first container, an integral radial portion adapted to overlay said rim portion of said first container and a tubular housing portion integral with said radial portion generally coaxially aligned with said first container open end having an open distal end;

a generally tubular transfer member located within said tubular housing portion of said tubular housing member having a proximate end sealingly engaging said closure in said first container open end and an open distal end;

a piercing member telescopically received in said tubular transfer member having a proximate piercing end adapted to pierce said closure and an open distal end; and a cap having a central portion releasably secured to and sealing said open distal end of said tubular housing portion of said tubular housing member having an integral connector portion releasably retaining said distal end of said piercing member prior to removal of said central portion of said cap from said tubular housing member.

25. The transfer set as defined in claim 24, wherein said cap includes an outer tubular portion surrounding an outer surface of said tubular housing portion of said tubular housing member having a frangible connector portion interconnecting said central portion and said outer tubular portion and permitting removal of said central portion.

26. The transfer set as defined in claim 24, wherein an internal surface of said tubular housing portion of said tubular housing member includes a radially inwardly projecting rib supporting said tubular transfer member.

27. The transfer set as defined in claim 26, wherein an outer surface of said tubular transfer member includes a camming surface having a major diameter greater than an internal diameter of said radially inwardly projecting rib including an annular end surface received on said radially inwardly projecting rib supporting said tubular transfer member in said tubular housing portion of said tubular housing member.

28. The transfer set as defined in claim 27, wherein said camming surface is frusto-conical.

29. The transfer set as defined in claim 27, wherein said external surface of said tubular transfer member includes a radial rib having an external diameter greater than said internal diameter of said radially inwardly projecting rib having an end surface adjacent to but spaced from said annular end surface of said camming surface and said radially inwardly projecting rib is received between said annular end surface of said camming surface and said end surface of said radial rib on said tubular transfer member securing said tubular transfer member in said tubular housing portion of said tubular housing member.

* * * * *